US009213265B2

(12) United States Patent
Kusukawa

(10) Patent No.: US 9,213,265 B2
(45) Date of Patent: Dec. 15, 2015

(54) DEVELOPING DEVICE AND IMAGE FORMING APPARATUS WITH CLEANING CONTACT MEMBER

(71) Applicant: KYOCERA Document Solutions Inc., Osaka-shi, Osaka (JP)

(72) Inventor: Takashi Kusukawa, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/293,999

(22) Filed: Jun. 2, 2014

(65) Prior Publication Data

US 2014/0363179 A1 Dec. 11, 2014

(30) Foreign Application Priority Data

Jun. 11, 2013 (JP) ..... 2013-122853

(51) Int. Cl.
*G03G 15/08* (2006.01)

(52) U.S. Cl.
CPC ..... *G03G 15/0889* (2013.01); *G03G 15/0856* (2013.01); *G03G 15/086* (2013.01)

(58) Field of Classification Search
CPC ..... G03G 15/0889; G03G 15/0856; G03G 15/086
USPC ..... 399/27, 11, 119, 120, 258, 260, 263
See application file for complete search history.

(56) References Cited

U.S. PATENT DOCUMENTS

| | | | | |
|---|---|---|---|---|
| 5,784,669 | A * | 7/1998 | Miura et al. | 399/58 |
| 6,212,341 | B1 * | 4/2001 | Miyamura et al. | 399/58 |
| 2006/0067718 | A1 * | 3/2006 | Toda et al. | 399/27 |
| 2007/0253720 | A1 * | 11/2007 | Kasai | 399/27 |
| 2009/0162107 | A1 * | 6/2009 | Yoshikawa et al. | 399/263 |
| 2012/0207490 | A1 * | 8/2012 | Itoyama et al. | 399/27 |

FOREIGN PATENT DOCUMENTS

| | | | |
|---|---|---|---|
| JP | 07128972 | A | 5/1995 |
| JP | 2000112220 | A | 4/2000 |
| JP | 2000112221 | A | 4/2000 |
| JP | 2002268368 | A | 9/2002 |

* cited by examiner

*Primary Examiner* — Benjamin Schmitt
*Assistant Examiner* — Matthew Miller
(74) *Attorney, Agent, or Firm* — Alleman Hall McCoy Russell & Tuttle LLP

(57) ABSTRACT

A developing device includes a developer storage container, a remaining amount detecting portion, an agitating portion, a contact member, and a support portion. The agitating portion is configured to be rotated to thereby agitate the developer. The contact member is attached to the agitating portion, and is configured to, when the agitating portion is rotated in a predetermined first rotational direction, move in the first rotational direction and make contact with a sensing surface. The support portion is attached to the agitating portion, and is configured to, when the agitating portion is rotated in the first rotational direction, support the contact member in a first position where the contact member can make contact with the sensing surface, and, when the agitating portion is rotated in a second rotational direction opposite to the first rotational direction, support the contact member in a second position distant from the sensing surface.

5 Claims, 9 Drawing Sheets

DEVELOPING DEVICE AND IMAGE FORMING APPARATUS WITH CLEANING CONTACT MEMBER

INCORPORATION BY REFERENCE

This application is based upon and claims the benefit of priority from the corresponding Japanese Patent Application No. 2013-122853 filed on Jun. 11, 2013, the entire contents of which are incorporated herein by reference.

BACKGROUND

The present disclosure relates to a developing device including a contact member configured to clean a sensing surface, and an image forming apparatus including the developing device.

There have been known image forming apparatuses, such as copy machines and printers, which form images on sheets by electrophotography. Such an image forming apparatus includes a developing device configured to develop an electrostatic latent image formed on an image-carrying member such as a photosensitive drum. In the developing device, toner is stored. The developing device develops the electrostatic latent image with toner to form a toner image. The toner image is transferred onto a sheet by a transfer device. The sheet, which has the toner image transferred thereon, is heated and pressed by a fixing device. The toner image is thus fixed onto the sheet. After that, the sheet, on which the toner image is fixed, is discharged from the apparatus. Thus, a series of image forming operations is completed.

Meanwhile, when the toner in the developing device is reduced because the toner has been consumed in the image forming operations, toner is additionally supplied from a toner container to the developing device. The developing device includes a toner density sensor such that toner is supplied from the toner container at appropriate times. The toner density sensor detects toner density which varies depending on the amount of remaining toner. The toner container has a sensing surface on an inner wall, and the toner density sensor detects the toner density via the sensing surface. The sensing surface is located in the toner container. Therefore, when, for example, toner adheres to the sensing surface or is accumulated near the sensing surface, the toner density sensor becomes no longer capable of accurately detecting the toner density. There has been conventionally known a developing device configured such that (i) a sensor cleaning member is provided with an agitating member configured to agitate toner and (ii) as the agitating member rotates, the sensor cleaning member makes contact with the sensing surface and slides on the sensing surface.

The developing device is configured such that a plurality of rotatable members, such as a developing roller (toner-carrying member) and the agitating member, are driven by a single driving motor. During development, the rotational force of the driving motor is transmitted via a gear to the plurality of rotatable members such as the agitating member. Thus, the plurality of rotatable members are rotated forward at a rate determined according to the gear. Meanwhile, if the developing roller or the like always rotate in one direction, time periods during which toner is accumulated may be different depending on positions in the toner container or some toner may descend and form a deposit in some positions in the toner container. In this case, a problem arises in that the toner which has been accumulated for different time periods or the toner which has formed the deposit are mixed, to cause variations in quality of toner as a whole and cause deterioration in development quality. There has been conventionally known a developing device configured such that, while no development is performed, the developing roller is rotated in the reverse direction by the driving motor so that the toner that has been accumulated or the toner that has formed the deposit is agitated and thereby variations in quality of toner can be reduced.

SUMMARY

A developing device according to one aspect of the present disclosure includes a developer storage container, a remaining amount detecting portion, an agitating portion, a contact member, and a support portion. The developer storage container has a sensing surface therein and is configured to store developer. The remaining amount detecting portion is configured to detect, via the sensing surface, an amount of the developer remaining. The agitating portion is disposed inside the developer storage container so as to be rotatable and configured to be rotated to thereby agitate the developer. The contact member is attached to the agitating portion, and is configured to, when the agitating portion is rotated in a predetermined first rotational direction, move in the first rotational direction and make contact with the sensing surface. The support portion is attached to the agitating portion, and is configured to, when the agitating portion is rotated in the first rotational direction, support the contact member in a first position where the contact member can make contact with the sensing surface, and, when the agitating portion is rotated in a second rotational direction that is opposite to the first rotational direction, support the contact member in a second position distant from the sensing surface.

An image forming apparatus according to another aspect of the present disclosure includes the developing device.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, embodiments of the present disclosure will be described with reference to the accompanying drawings for understanding of the present disclosure.

<Schematic Configuration of Image Forming Apparatus 100>

Figure 1A:
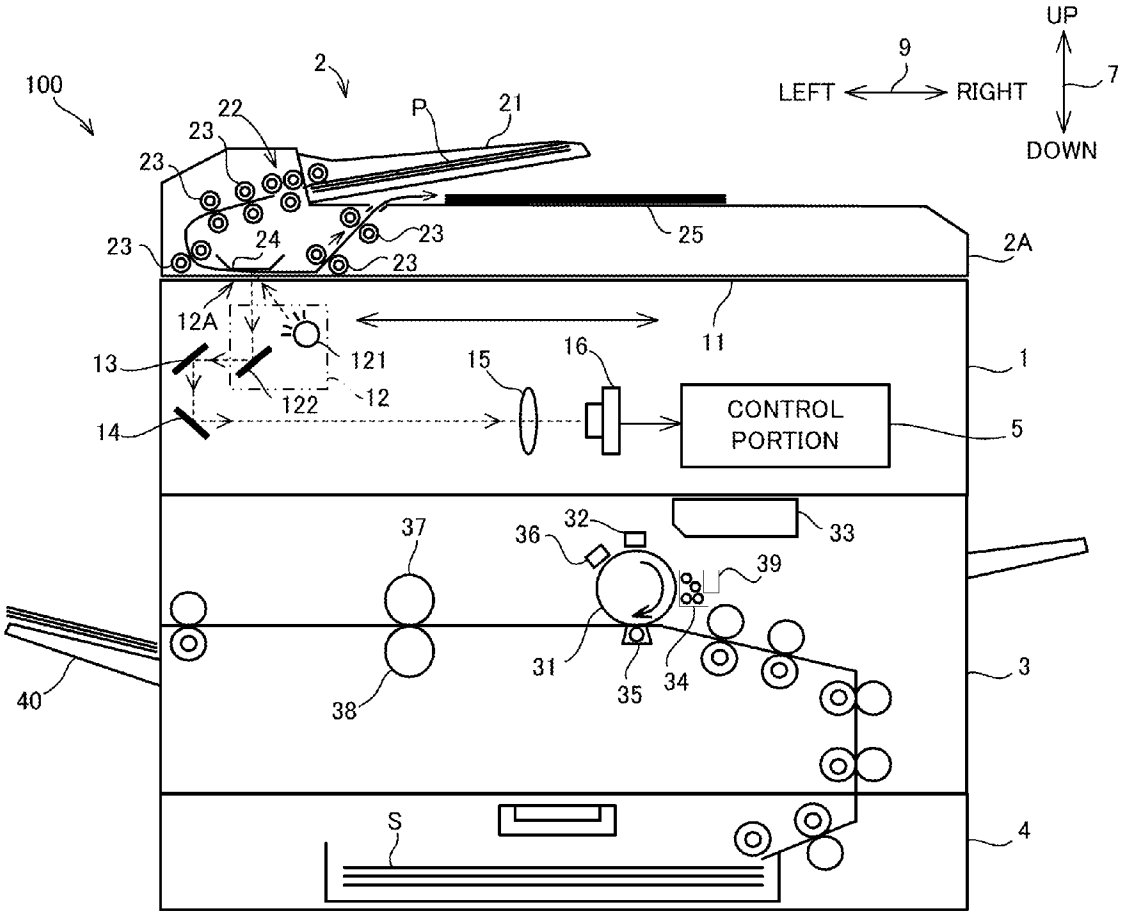
FIG. 1A and FIG. 1B are a cross-sectional view and a plan view each illustrating a configuration of an image forming apparatus including a developing device according to one embodiment of the present disclosure.
Figure 1B:
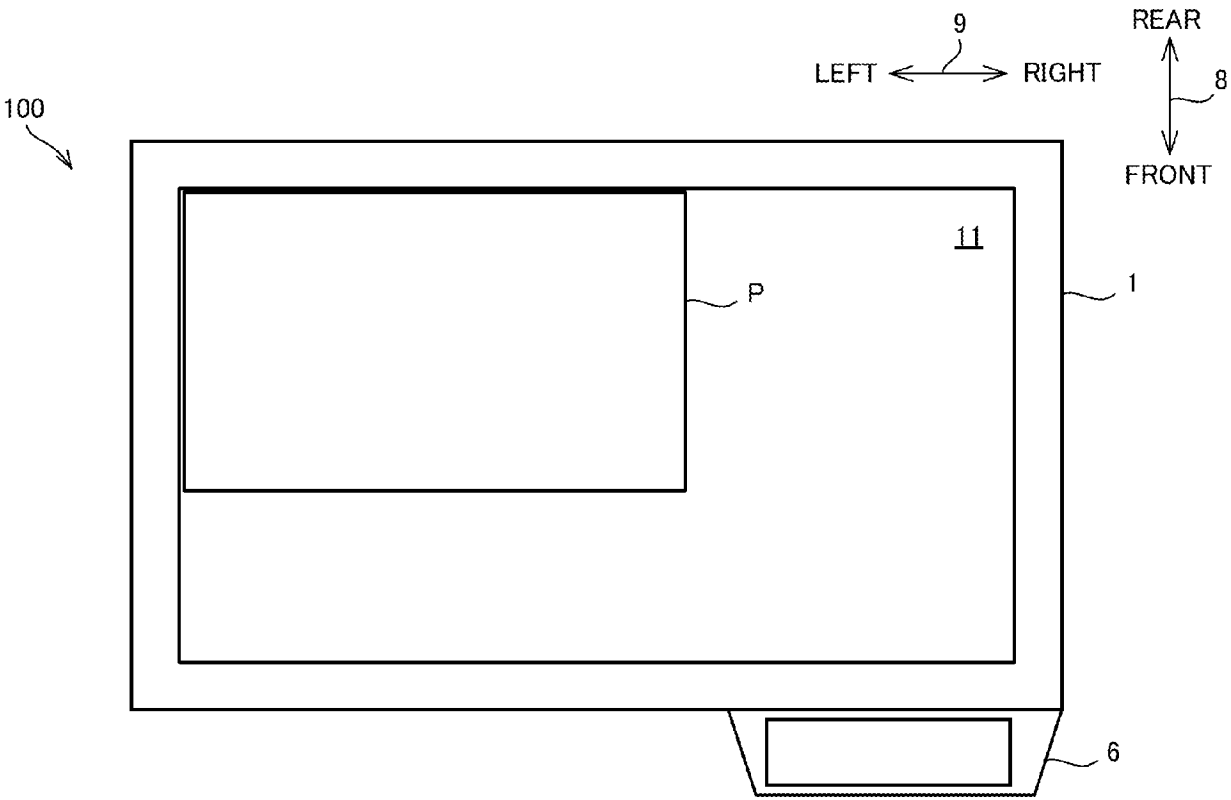

First, the following description discusses a schematic configuration of an image forming apparatus 100 according to one embodiment of the present disclosure. As illustrated in FIGS. 1A and 1B, the image forming apparatus 100 includes an image reading portion 1, an ADF (Automatic Document Feeder) 2, an image forming portion 3, a sheet feed portion 4, a control portion 5, an operation display portion 6, and the like. The operation display portion 6 is a touch panel or the like which is configured to display various information in response to control instructions from the control portion 5 and supply, to the control portion 5, various information corresponding to user's operations. FIG. 1A is a front view of the image forming apparatus 100, and FIG. 1B is a plan view of the image reading portion 1. For convenience of description, an up-down direction 7 is defined as the vertical direction in a state where the image forming apparatus 100 is mounted so as to be usable, a front-rear direction 8 is defined based on the near side (front surface side) representing a side on which the operation display portion 6 is disposed, and a right-left direction 9 is defined based on the front surface side representing a side surface on which the operation display portion 6 is disposed. It should be noted that the image forming apparatus 100 is one example of an image forming apparatus according to the present disclosure. The image forming apparatus according to the present disclosure may be a printer, a FAX apparatus, a copy machine or the like.

The image reading portion 1 obtains image data from a sheet P. The image reading portion 1 includes a sheet cover 2A, a contact glass 11, a reading unit 12, a mirror 13, a mirror 14, an optical lens 15, a CCD (Charge Coupled Device) 16, and the like. The contact glass 11 is provided on the top surface of the image reading portion 1. The contact glass 11 is a transparent sheet table on which the sheet P having an image to be read by the image forming apparatus 100, is to be placed.

The sheet cover 2A covers the contact glass 11 when necessary. According to control by the control portion 5, the image reading portion 1 reads an image from the sheet P which is placed on the contact glass 11.

The reading unit 12 includes an LED light source 121 and a mirror 122, and is configured to be movable along a sub-scanning direction (the right-left direction 9 in FIGS. 1A and 1B) by a moving mechanism such as a stepping motor (not illustrated). When the reading unit 12 is moved along the sub-scanning direction by the moving mechanism, light applied toward the contact glass 11 from the LED light source 121 is scanned in the sub-scanning direction.

The LED light source 121 includes a number of white LEDs arranged along a main-scanning direction (the front-rear direction 8 in FIGS. 1A and 1B) of the image forming apparatus 100. The LED light source 121 emits a line of white light toward the sheet P on a reading point 12A on the contact glass 11. When the reading unit 12 moves along the sub-scanning direction, the reading point 12A also moves along the sub-scanning direction.

The mirror 122 receives light that is emitted from the LED light source 121 and reflected by the sheet P in the reading point 12A, and reflects the light toward the mirror 13. The light reflected by the mirror 122 is guided to the optical lens 15 via the mirror 13 and the mirror 14. The optical lens 15 focuses the incident light on the CCD 16.

The CCD 16 is a photoelectric converter configured to convert the received light into an electric signal (voltage) corresponding to the amount of the light and supply the electric signal to the control portion 5. Specifically, the CCD 16 produces, from the light that is emitted from the LED light source 121 and reflected by the sheet P, an electric signal corresponding to the image on the sheet P, and generates image data on the basis of the electric signal.

The ADF 2 is provided in the sheet cover 2A. The ADF 2 is an automatic document feeding device which includes a sheet tray 21, a feed mechanism 22, a plurality of conveying rollers 23, a sheet holding member 24, a sheet discharge portion 25, and the like. The ADF 2 is configured such that, by the feed mechanism 22 and the conveying rollers 23 being driven by a stepping motor (not illustrated), a sheet P set in the sheet tray 21 is conveyed to the sheet discharge portion 25 via the reading point 12A on the contact glass 11. In this case, when the sheet P passes through the reading point 12A, the image on the sheet P is read by the image reading portion 1.

The sheet holding member 24 is positioned above the reading point 12A of the contact glass 11 with a gap that allows the sheet P to pass through. The sheet holding member 24 is elongated in the main-scanning direction. The sheet holding member 24 has a white sheet attached to its lower surface (the surface facing the contact glass 11). In the image forming apparatus 100, image data of this white sheet is read as white reference data. The white reference data is used for well-known shading correction or the like.

The image forming portion 3 performs an image forming process (printing process) by electrophotography. The image forming portion 3 performs the image forming process on the basis of image data read by the image reading portion 1 or on the basis of image data externally supplied from an information processing device such as a personal computer. The image forming portion 3 includes a photosensitive drum 31, a charging device 32, an LSU (Laser Scanning Unit) 33, a developing device 34 (one example of a developing device), a transfer roller 35, an electricity removing device 36, a fixing roller 37, a pressure roller 38, a toner container 39, and the like.

The image forming portion 3 is configured such that (i) an image is formed in the following manner on a sheet S which is fed from the sheet feed portion 4 and (ii) the sheet S, which has the image formed thereon, is discharged onto a sheet discharge tray 40. Specifically, first, the photosensitive drum 31 is uniformly charged at a predetermined potential by the charging device 32. Next, light based on the image data is applied to the surface of the photosensitive drum 31 by the LSU 33. In this way, an electrostatic latent image is formed on the surface of the photosensitive drum 31. Then, the electrostatic latent image on the photosensitive drum 31 is developed (visualized) into a toner image by the developing device 34. Next, the toner image on the photosensitive drum 31 is transferred to the sheet S by the transfer roller 35. After that, when the sheet S passes between the fixing roller 37 and the pressure roller 38 and is discharged, the toner image on the sheet S is heated by the fixing roller 37 and is thereby fused and fixed to the sheet S. The potential of the photosensitive drum 31 is removed by the electricity removing device 36. The developing device 34 will be described below in detail.

The sheet feed portion 4 feeds a sheet S on which an image is to be formed by the image forming portion 3. The sheet feed portion 4 feeds a plurality of sheets S, which are placed in a sheet feed cassette (not illustrated) mounted to a cassette mounting portion (not illustrated), one by one to the image forming portion 3.

Figure 5:
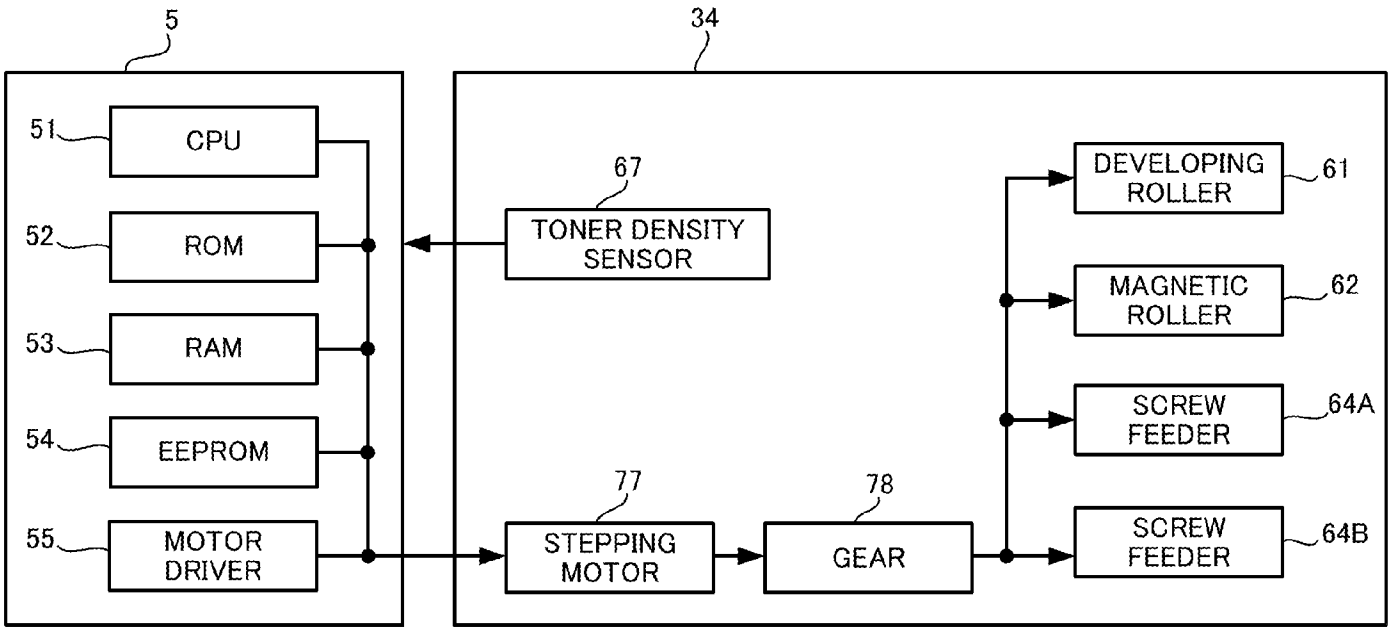
FIG. 5 is a block diagram showing a control portion configured to control the developing device and a driving force transmitting mechanism of the developing device.

Next, the following schematically describes the functions of the control portion 5 with reference to FIG. 5. The control portion 5 includes a CPU 51, a ROM 52, a RAM 53, an EEPROM 54, a motor driver 55, and the like. The control portion 5 comprehensively controls the image forming apparatus 100 by causing the CPU 51 to execute a predetermined control program stored in the ROM 52. Specifically, the ROM 52 previously stores, for example, an image formation processing program used to form images and a drive control program used to drive a stepping motor 77 connected to the developing device 34. According to the present embodiment, during image formation, the CPU 51 causes the stepping motor 77 to rotate in a rotation direction that allows toner to be supplied to the photosensitive drum 31. On the other hand, while no images are being formed, the CPU 51 causes the stepping motor 77 to rotate in a direction opposite to the rotation direction during image formation (during development). Thus, toner that is accumulated or forms a deposit in the developing device 34 is agitated and mixed, thereby preventing variation in toner quality.

The RAM 53 is a volatile storage portion, whereas the EEPROM 54 is a nonvolatile storage portion. The RAM 53 and the EEPROM 54 serve as memories configured to temporarily store data when the CPU 51 performs various processes. The motor driver 55 drives the stepping motor 77 under control of the CPU 51. Furthermore, the control portion 5 is connected with a toner density sensor 67 of the developing device 34. The control portion 5 receives a voltage signal representing information of toner density detected by the toner density sensor 67. The control portion 5 may be configured as an electronic circuit such as an integrated circuit (ASIC, DSP). Alternatively, the control portion 5 may be a control portion provided separately from a main control portion for overall control of the image forming apparatus 100.

<Configuration of Developing Device 34>

Figure 2:
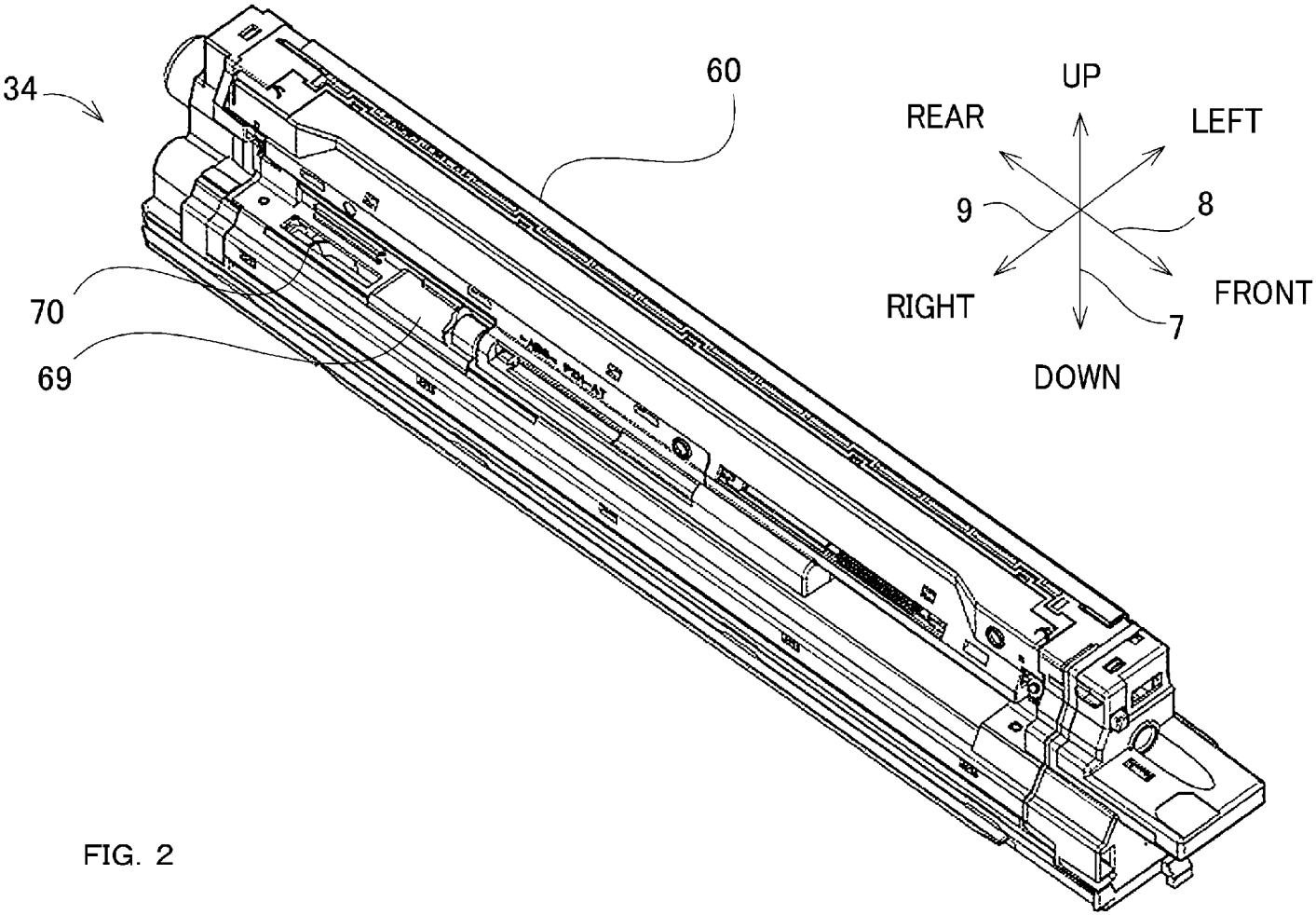
FIG. 2 is a perspective view of the developing device.
Figure 3:
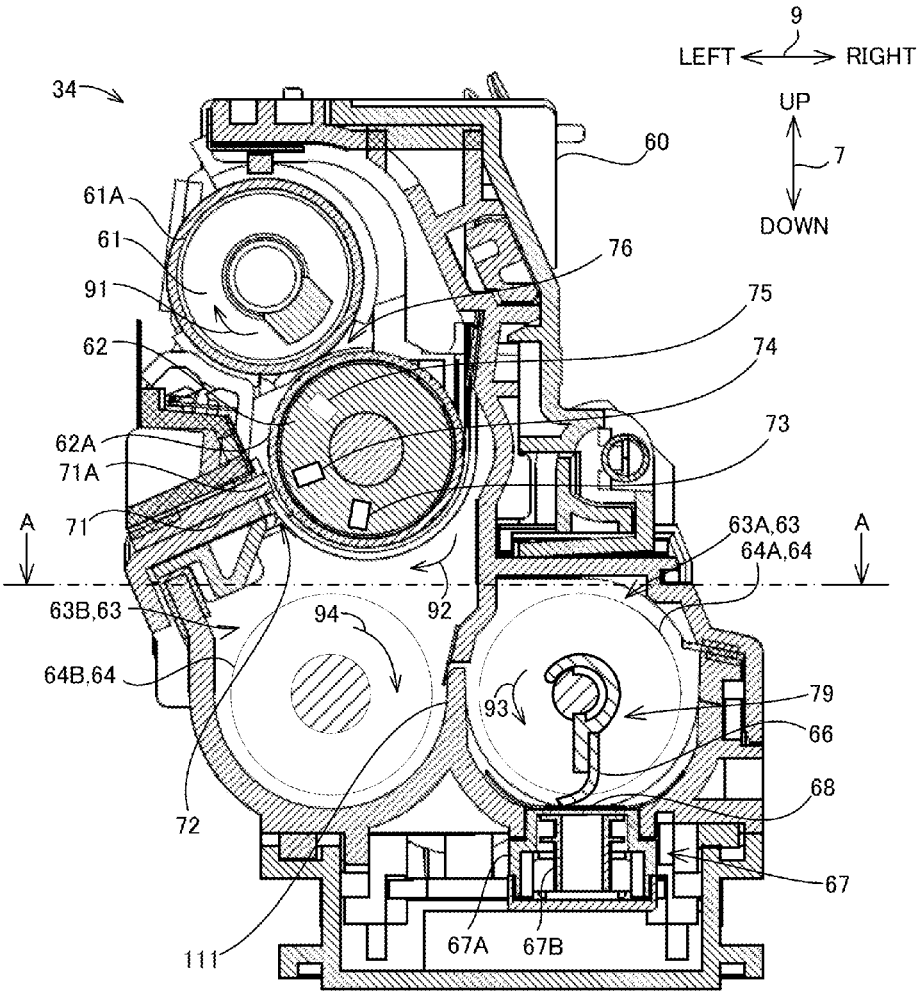
FIG. 3 is a cross-sectional view schematically illustrating a configuration of the developing device.
Figure 4:
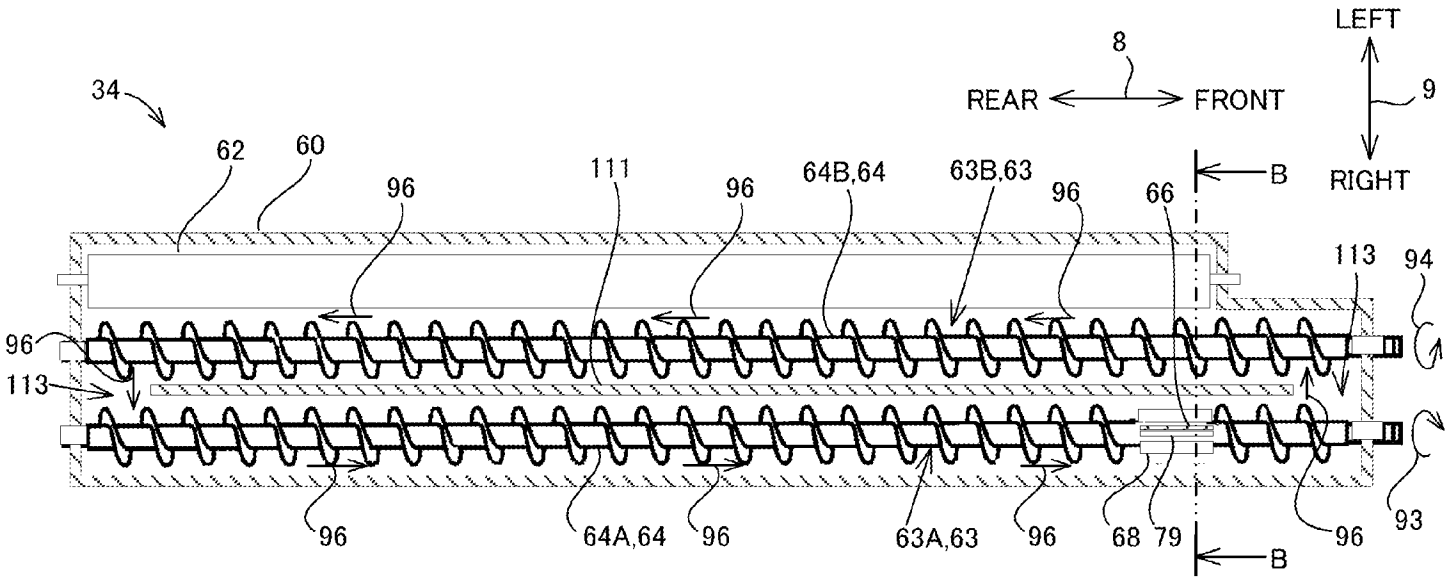
FIG. 4 is a cross-sectional view illustrating an agitating portion of the developing device.

Next, the following description discusses the developing device 34 in detail with reference to FIGS. 2 to 5. FIG. 4 is a cross-sectional view taken along a line A-A in FIG. 3.

The developing device 34 uses so-called two-component developer composed of two components, i.e. toner and magnetic carrier, to develop an image. As illustrated in FIG. 2, the developing device 34 has a shape elongated in the front-rear direction 8. The developing device 34 has a supply opening 70 in its outer surface and has a shutter 69 configured to open and close the supply opening 70. When toner, which is non-magnetic, is supplied from the toner container 39 (see FIG. 1A) to the developing deice 34, the shutter 69 is slid by a solenoid to open the supply opening 70. When toner is not supplied, the shutter 69 is slid by the solenoid to close the supply opening 70.

As illustrated in FIG. 3, the developing device 34 includes a storage portion 63 (one example of a developer storage container), a screw feeder 64A (one example of an agitating portion), a screw feeder 64B, a scraper 66 (one example of a contact member), the toner density sensor 67, a developing roller 61, a magnetic roller 62, a developer regulation blade 71, and the like. These components are provided within a housing 60 of the developing device 34. The storage portion 63 is formed in the bottom portion of the housing 60 and is integral with the housing 60. The storage portion 63 is a storage container for storing the two-component developer, including non-magnetic toner and magnetic carrier, which is supplied from the toner container 39. The magnetic roller 62, which is a developer-carrying member, is positioned above the storage portion 63. The developing roller 61, which is a toner-carrying member, is positioned diagonally above the magnetic roller 62 so as to face the magnetic roller 62. The developer regulation blade 71 is positioned so as to face the magnetic roller 62.

As shown in FIG. 5, the developing roller 61, the magnetic roller 62, the screw feeder 64A and the screw feeder 64B are connected to the stepping motor 77 via a gear 78 (driving force transmitting mechanism). The stepping motor 77 supplies a rotational driving force via the gear 78 to thereby cause the screw feeder 64A, the screw feeder 64B, the developing roller 61 and the magnetic roller 62 to rotate together.

During development, the stepping motor 77 causes the developing roller 61 and the magnetic roller 62 to each rotate in a forward rotation direction (the directions indicated by arrows 91 and 92 in FIG. 3, each corresponding to a first rotational direction) according to control by the control portion 5. Correspondingly, the screw feeder 64A and the screw feeder 64B each rotate in the forward rotation direction (the directions indicated by arrows 93 and 94 in FIGS. 3 and 4) which is determined according to the gear 78. Thus, toner is supplied to the photosensitive drum 31. On the other hand, while development is not being performed, the stepping motor 77 causes the developing roller 61 and the magnetic roller 62 to each rotate in a reverse rotational direction (the directions opposite to the directions indicated by the arrows 91 and 92 in FIG. 3, each corresponding to a second rotational direction) that is opposite to the forward rotation direction according to the control by the control portion 5. Correspondingly, the screw feeder 64A and the screw feeder 64B each rotate in the reverse rotational direction (the directions opposite to the directions indicated by the arrows 93 and 94 in FIGS. 3 and 4) determined according to the gear 78. This makes it possible to agitate toner that is accumulated or that forms a deposit in positions where they cannot be agitated by the rotation in the forward rotation direction.

As illustrated in FIG. 4, the storage portion 63 has two adjacent storage chambers 63A and 63B each extending along the longitudinal direction of the developing device 34 (along the front-rear direction 8). Each of the storage chambers 63A and 63B is formed into a cylindrical shape elongated in the front-rear direction 8. The storage chambers 63A and 63B are integral with the housing 60, and are separated from each other by a partition 111 extending in the front-rear direction 8. Note, however, that the storage chambers 63A and 63B are not completely separated from each other. As illustrated in FIG. 4, the partition 111 is not formed at both end portions in the front-rear direction 8. Specifically, the storage chambers 63A and 63B communicate with each other at both the end portions through communication paths 113.

In the storage chambers 63A and 63B, the screw feeders 64A and 64B are provided, respectively. The screw feeders 64A and 64B are formed of synthetic resin. The screw feeders 64A and 64B are rotated about their axes and thereby convey the developer while agitating the developer. Each of the screw feeders 64A and 64B has a helical blade around its shaft. The screw feeders 64A and 64B are rotated by a rotational driving force from the stepping motor 77. The screw feeders 64A and 64B are configured to rotate in rotational directions opposite to each other. Thus, the developer being agitated is circulated and conveyed in and between the storage chamber 63A and the storage chamber 63B in the direction indicated by an arrow 96 in FIG. 4. With this agitation, the toner in the developer can be electrically charged.

As illustrated in FIG. 4, a sensing surface 68 is formed near one end portion (the front-side end) of the storage chamber 63A. The toner density sensor 67 is fitted into an opening formed on the bottom surface of the storage chamber 63A, whereby a part (specifically, the top surface) of a casing 67A of the toner density sensor 67 is exposed in the storage chamber 63A and the sensing surface 68 is formed at the bottom of the storage chamber 63A (this is described below). The sensing surface 68 is flat so that the toner density sensor 67 can accurately measure the toner density of the developer. According to the present embodiment, the sensing surface 68 is positioned so as to be distant in the upward direction from the bottom surface of the storage chamber 63A having a cylindrical shape. In other words, the distance from the rotation center of a rotation shaft 65 of the screw feeder 64A to the sensing surface 68 is shorter than the distance from the rotation center of the rotation shaft 65 to the inner wall of the storage chamber 63A.

The screw feeder 64A has, in the vicinity of the sensing surface 68, a support mechanism 79 (one example of a support portion) to which the scraper 66 is attached. The support mechanism 79 is formed of the same synthetic resin as the screw feeder 64A. The support mechanism 79 supports the scraper 66 in a first position (described below) when the screw feeder 64A is rotated in the forward rotation direction. Furthermore, the support mechanism 79 supports the scraper 66 in a second position (described below) when the screw feeder 64A is rotated in the reverse rotational direction. It should be noted here that the first position is a position where the sensing surface 68 is within reach of the scraper 66 when the scraper 66 passes over the sensing surface 68, and the second position is a position where the scraper 66 is distant in the upward direction from the sensing surface 68 and makes no contact with the sensing surface 68 when the scraper 66 passes over the sensing surface 68. The support mechanism 79 and the scraper 66 will be described below.

The magnetic roller 62 is positioned so as to extend along the longitudinal direction of the developing device 34 (along the front-rear direction 8). The magnetic roller 62 is rotated in a clockwise rotational direction in FIG. 3 (the direction indicated by the arrow 92 in FIG. 3) during development. The magnetic roller 62 has, therein, a so-called magnet roll (not illustrated) which is fixed. The magnet roll has a plurality of magnetic poles, which are, in the present embodiment, a scooping pole 73, a regulation pole 74, and a main pole 75. The scooping pole 73 faces the storage portion 63, the regulation pole 74 faces the developer regulation blade 71, and the main pole 75 faces the developing roller 61.

The magnetic roller 62 magnetically scoops, by a magnetic force of the scooping pole 73, developer from the storage portion 63 onto a magnetic roller circumferential surface 62A. The scooped developer is held magnetically as developer layer (magnetic brush layer) on the magnetic roller circumferential surface 62A, and is conveyed toward the developer regulation blade 71 according to the rotation of the magnetic roller 62.

The developer regulation blade 71 is positioned upstream of the developing roller 61 as viewed in the rotational direction of the magnetic roller 62, and regulates the thickness of the developer layer which is magnetically attached to the magnetic roller circumferential surface 62A. The developer regulation blade 71 is a plate member formed of a magnetic material and extending in the front-rear direction 8 along the magnetic roller 62, and is attached to the housing 60. The developer regulation blade 71 has a regulation surface 71A (i.e., an edge face of the developer regulation blade 71). The regulation surface 71A and the magnetic roller circumferential surface 62A define a regulation gap 72 having a predetermined size.

The developer regulation blade 71, which is formed of a magnetic material, is magnetized by the regulation pole 74 of the magnetic roller 62. Thus, a magnetic path is formed between the regulation surface 71A of the developer regulation blade 71 and the regulation pole 74, i.e., formed in the regulation gap 72. As the magnetic roller 62 rotates, the developer layer formed on the magnetic roller circumferential surface 62A by the scooping pole 73 is conveyed into the regulation gap 72, in which the thickness of the developer layer is regulated. Thus, the developer layer is formed on the magnetic roller circumferential surface 62A so as to uniformly have a predetermined thickness.

The developing roller 61 is positioned so as to extend along the longitudinal direction of the developing device 34 (along the front-rear direction 8) parallel to the magnetic roller 62. The developing roller 61 is rotated in the clockwise rotational direction in FIG. 3 (the direction indicated by the arrow 91 in FIG. 3) during development. While the developing roller 61 rotates in a state where the developing roller 61 contacts with the developer layer retained on the magnetic roller circumferential surface 62A, the developing roller 61 receives toner from the developer layer and carries a layer of the toner on a developing roller circumferential surface 61A. During development, the toner in the toner layer is supplied to a circumferential surface of the photosensitive drum 31.

The developing roller 61 and the magnetic roller 62 are rotated by the stepping motor 77. A gap 76 (see FIG. 3) having a predetermined size is formed between the developing roller circumferential surface 61A and the magnetic roller circumferential surface 62A. The gap 76 is set so as to have a size of, for example, approximately 130 μm. The developing roller 61 is positioned so as to face the photosensitive drum 31 via an opening formed in the housing 60. A gap having a predetermined size (e.g., approximately 110 μm) is also formed between the developing roller circumferential surface 61A and the circumferential surface of the photosensitive drum 31.

The toner density sensor 67 detects, via the sensing surface 68, a density of the toner in the developer stored in the storage chamber 63A. Specifically, the toner density sensor 67 measures the magnetic permeability of the developer via the sensing surface 68, and supplies, to the control portion 5, a voltage signal having a voltage level corresponding to the measured magnetic permeability. As toner is consumed for development, the proportion (rate) of toner to the developer changes and therefore the magnetic permeability of the developer also changes. For example, if the proportion of the toner to the developer decreases, the magnetic permeability of the developer increases and therefore the voltage level of the voltage signal increases. The toner density sensor 67 supplies, to the control portion 5, a voltage signal corresponding to the detected magnetic permeability. The control portion 5 determines the density of the toner in the developer on the basis of the received voltage signal. The toner density sensor 67 and the control portion 5 are one example of a remaining amount detecting portion of the present disclosure. In this way, the control portion 5 determines toner density by causing the toner density sensor 67 to detect the magnetic permeability of the developer which contains toner. The toner density sensor 67 may be one that has a built-in control substrate configured to determine toner density. In this case, the toner density sensor 67 is one example of the remaining amount detecting portion of the present disclosure.

Toner density changes depending on the amount of remaining toner. Therefore, the control portion 5 can detect the amount of toner remaining in the storage chamber 63A by detecting toner density. Specifically, the control portion 5 obtains, by use of the toner density sensor 67, the density of the toner in the developer via the sensing surface 68, and detects the amount of the remaining toner in the developer on the basis of the obtained toner density. Furthermore, when the detected amount of the remaining toner is less than a predetermined amount, the control portion 5 slides the shutter 69 to open the supply opening 70 so that toner is supplied from the toner container 39 to the developing device 34. In this way, the control portion 5 keeps the density of the toner in the developer stored in the developing device 34 so as to be within a predetermined range.

As illustrated in FIG. 3, the toner density sensor 67 has the casing 67A with a flat top surface. In the casing 67A, a sensor body 67B that can detect the magnetic permeability of the developer is disposed. According to the present embodiment, the storage chamber 63A has an opening formed on the bottom surface, and this opening passes through the bottom wall of the storage chamber 63A. The casing 67A is fitted in the opening. In this way, the flat top surface of the casing 67A is inserted into the storage chamber 63A through the bottom of the storage chamber 63A and serves as the sensing surface 68 on the bottom surface of the storage chamber 63A.

In a conventional support mechanism for a scraper 66, reverse rotation of a developing roller 61 causes reverse rotation of a screw feeder 64A. In this case, the scraper 66 attached to the screw feeder 64A moves so as to be in sliding-contact with the sensing surface 68 from the direction opposite to the direction from which the scraper 66 contacts therewith during development, and thus experiences a force from a direction opposite to that during development. Therefore, when the screw feeder 64A is rotated in the reverse direction according to the reverse rotation of the developing roller 61, a portion where the screw feeder 64A and the scraper 66 are attached to each other experiences an increased load. As a result, the scraper 66 may be dropped from the screw feeder 64A or, in some cases, the scraper 66 may be broken at a buckling point at which it buckles when the scraper 66 contacts with the sensing surface 68. For the purpose of solving such a problem, the support mechanism 79 is configured as below.

Figure 6A:
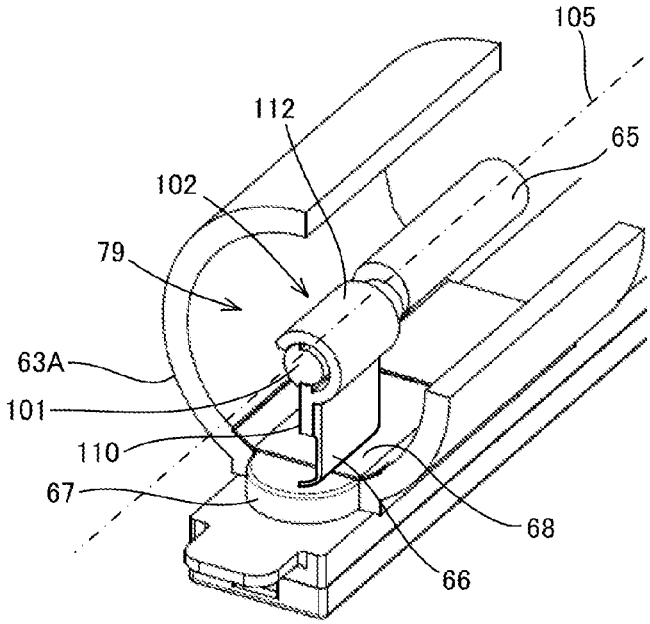
FIG. 6A illustrates a configuration of a support mechanism for a contact member of the developing device.

The following description discusses, with reference to FIGS. 6A to 8C, configurations and operations of the support mechanism 79 and the scraper 66. FIG. 6A is a perspective view of a structure of the support mechanism 79 and the vicinity thereof, and FIG. 6B is a cross-sectional view illustrating a cross-sectional structure of the support mechanism 79.

Figure 6B:
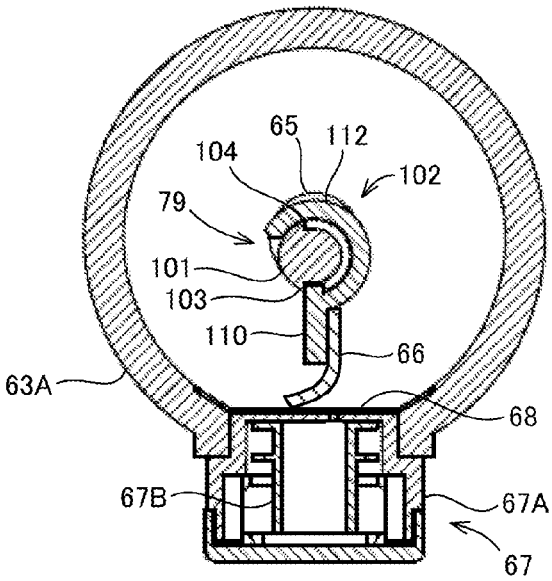
FIG. 6B is a cross-sectional view illustrating the support mechanism.

As illustrated in FIGS. 6A and 6B, the support mechanism 79 includes a shaft-like member 101, an outer fit portion 102, and an extending portion 110. The shaft-like member 101, the outer fit portion 102 and the extending portion 110 are each formed of synthetic resin, as with the screw feeder 64A.

Figure 7:
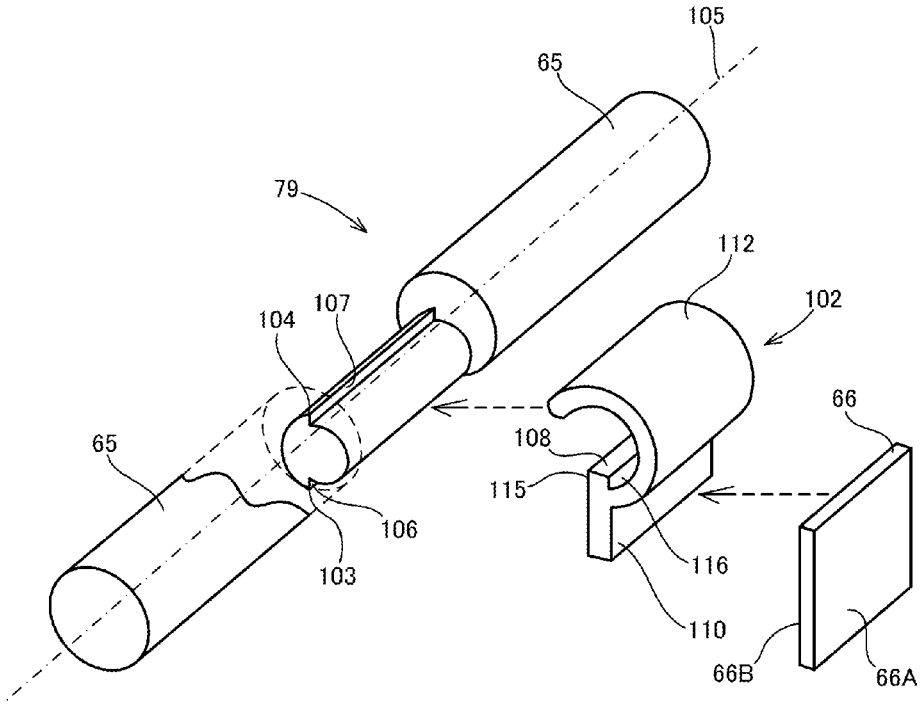
FIG. 7 is an exploded perspective view illustrating the support mechanism for the contact member.

The shaft-like member 101 is a shaft-shaped member, and extends in the same direction as the axial direction of the rotation shaft 65 of the screw feeder 64A. The shaft-like member 101 is positioned such that the center of the shaft-like member 101 is distant from a rotation center 105 of the rotation shaft 65 in the direction perpendicular to the rotation shaft 65. That is, the center of the rotation shaft 65 and the center of the shaft-like member 101 are shifted from each other in the direction perpendicular to the rotation center 105. As illustrated in FIG. 7, the shaft-like member 101 is attached to a part, of the rotation shaft 65, which corresponds to the sensing surface 68. Specifically, the shaft-like member 101 is attached to a part of the rotation shaft 65 in which the rotation shaft 65 and the sensing surface 68 overlap each other in planar view. The shaft-like member 101 may be integral with the rotation shaft 65 or may be provided separately from the rotation shaft 65.

As illustrated in FIG. 7, the shaft-like member 101 has two engaging parts 103 and 104. According to the present embodiment, the engaging part 104 is closer to the rotation center 105, whereas the engaging part 103 is farther from the rotation center 105 than the engaging part 104 is.

Figure 8A:
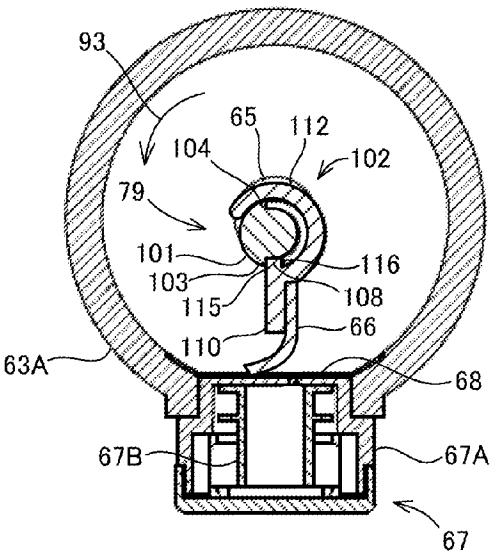
FIG. 8A, FIG. 8B and FIG. 8C each illustrate an example of operations of the contact member.

The engaging part 103 (one example of a first engaging portion) engages with the extending portion 110 (described below), when the screw feeder 64A is rotated in the forward rotation direction (the direction indicated by the arrow 93 in FIG. 3, i.e., a first rotational direction) and thereby the shaft-like member 101 reaches a first engagement position (the position illustrated in FIG. 8A), which is described below. When the screw feeder 64A is rotated further in the forward rotation direction in a state where the engaging part 103 and the extending portion 110 are in engagement with each other, the engaging part 103 of the shaft-like member 101 exerts a force for moving the scraper 66 together with the extending portion 110 in the forward rotation direction. It should be noted here that the first engagement position is, as illustrated in FIG. 8A, a position where the direction from the rotation center 105 of the rotation shaft 65 to the center of the shaft-like member 101 is the same as the direction in which the extending portion 110 extends. According to the present embodiment, when the screw feeder 64A is rotated in the forward rotation direction, the scraper 66 is supported by the support mechanism 79 in such a manner that the engaging part 103 and the extending portion 110 are in engagement with each other in the first engagement position. This position, in which the scraper 66 is supported by the support mechanism 79 in such a manner, is the aforementioned first position.

Figure 8B:
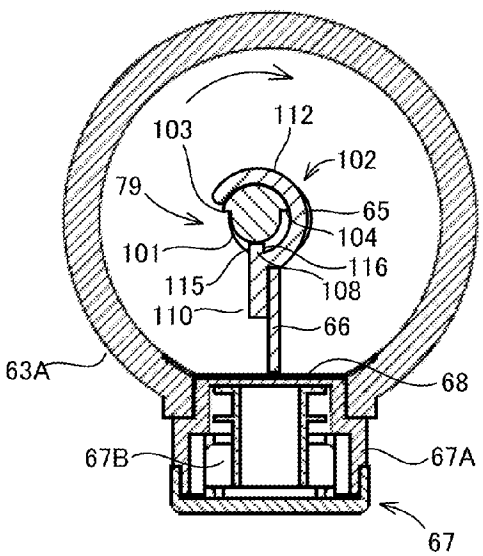
Figure 8C:
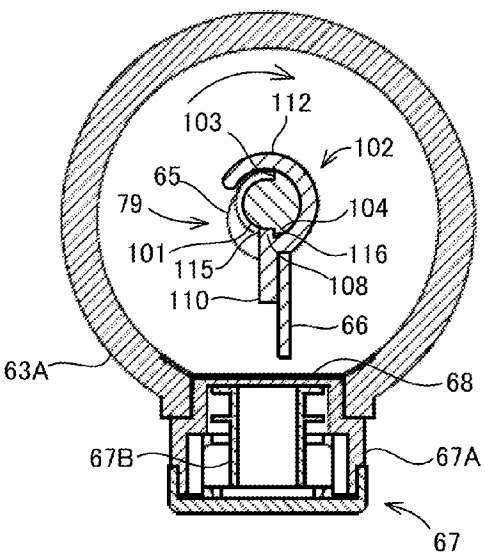

The engaging part 104 (one example of a second engaging portion) engages with the extending portion 110 (described below), when the screw feeder 64A is rotated in the reverse rotational direction (the direction opposite to that indicated by the arrow 93 in FIG. 3, i.e., a second rotational direction) and thereby the shaft-like member 101 reaches a second engagement position (the position illustrated in FIG. 8C), which is described below. When the screw feeder 64A is rotated further in the reverse rotational direction in a state where the engaging part 104 and the extending portion 110 are in engagement with each other, the engaging part 104 of the shaft-like member 101 exerts a force for moving the scraper 66 together with the extending portion 110 in the reverse rotational direction. It should be noted here that the second engagement position is, as illustrated in FIG. 8C, a position where the direction from the center of the shaft-like member 101 to the rotation center 105 of the rotation shaft 65 is the same as the direction in which the extending portion 110 extends. According to the present embodiment, when the screw feeder 64A is rotated in the reverse rotational direction, the scraper 66 is supported by the support mechanism 79 in such a manner that the engaging part 104 and the extending portion 110 are in engagement with each other in the second engagement position. This position, in which the scraper 66 is supported by the support mechanism 79 in such a manner, is the aforementioned second position.

The engaging parts 103 and 104 can be formed by, for example, shaving an outer circumferential surface of a cylindrical-rod-like member along a circumferential direction by a certain depth. By partially shaving the outer circumferential surface as described above, two stepped parts are formed between the shaved part and the outer circumferential surface of the cylindrical-rod-like member. These two stepped parts serve as the engaging parts 103 and 104. According to the present embodiment, the engaging parts 103 and 104 have stepped surfaces 106 and 107, respectively, each of which is parallel to a straight line connecting between the rotation center 105 of the rotation shaft 65 and the center of the shaft-like member 101. The stepped surface 106 (one example of an engaging surface) of the engaging part 103 is a part that is to contact with one side surface 115 (see FIG. 7) of a receiving portion 108 (described below) of the extending portion 110 of the outer fit portion 102. As illustrated in FIG. 8A, the stepped surface 106 of the engaging part 103 and the side surface 115 contact with each other, whereby the engaging part 103 and the receiving portion 108 engage with each other. On the other hand, the stepped surface 107 (one example of an engaging surface) of the engaging part 104 is a part that is to contact with the other side surface 116 of the receiving portion 108 (described below) of the extending portion 110 of the outer fit portion 102. As illustrated in FIG. 8C, the stepped surface 107 of the engaging part 104 and the side surface 116 contact with each other, whereby the engaging part 104 and the receiving portion 108 engage with each other.

The outer fit portion 102 has a hollow semi-tubular portion 112 configured to fit the outer circumferential surface of the shaft-like member 101. The hollow portion of the semi-tubular portion 112 is fitted to the outer circumferential surface of the shaft-like member 101, whereby the outer fit portion 102 is attached to the shaft-like member 101. According to the present embodiment, the semi-tubular portion 112 can be rotated in the circumferential direction of the shaft-like member 101 in a state where the outer fit portion 102 is attached to the shaft-like member 101. That is, a gap (allowance) is formed between the shaft-like member 101 and the semi-tubular portion 112 so as to allow the shaft-like member 101 and the semi-tubular portion 112 to rotate about the central axis.

The extending portion 110 is connected with the outer fit portion 102. The extending portion 110 is a flat-plate-like member that extends from an edge, in the circumferential direction, of the semi-tubular portion 112 of the outer fit portion 102 in the direction perpendicular to the center line of the semi-tubular portion 112. In other words, in a state where the outer fit portion 102 is attached to the shaft-like member 101, the extending portion 110 extends outward in the direction perpendicular to the rotation center 105 of the rotation shaft 65 so as to be away from the rotation center 105. Furthermore, the extending portion 110 has the receiving portion 108 (one example of a projecting portion) which projects toward an inner side of the semi-tubular portion 112. When the rotation shaft 65 is rotated, either the engaging part 103 or the engaging part 104 contacts and engages with the receiving portion 108.

The scraper 66 is attached to the screw feeder 64A via the support mechanism 79. When the screw feeder 64A is rotated in the forward rotation direction, the scraper 66 moves (rotates) in the forward rotation direction and makes contact with the sensing surface 68. Since the scraper 66 makes contact with the sensing surface 68, toner adhering to or accumulated on the sensing surface 68 can be swept. The scraper 66 is a flexible plate-like member formed as, for example, a polyethylene terephthalate film. The side surface, at one end, of the scraper 66 is joined to the side surface of the extending portion 110. Specifically, the scraper 66 is joined to the extending portion 110 at a joining surface 66B (see FIG. 7) of the scraper 66, which is opposite to a contact surface 66A of the scraper 66 on which the scraper 66 makes contact with the sensing surface 68 when the screw feeder 64A is rotated in the forward rotation direction. The scraper 66 and the extending portion 110 may be joined together with, for example, an adhesive member such as an adhesive agent or adhesive tape, or a fastener such as a screw.

<Effects of Embodiments>

According to the above embodiment, the developing device 34 includes the support mechanism 79. Therefore, the scraper 66 is supported either in the first position or in the second position depending on the rotational direction of the screw feeder 64A. Specifically, when the screw feeder 64A is rotated in the forward rotation direction (the direction indicated by the arrow 93), the shaft-like member 101 rotates about the rotation center 105 in the same rotational direction. After that, the shaft-like member 101 rotates inside the semi-tubular portion 112 until the engaging part 103 contacts with the receiving portion 108. Then, when the engaging part 103 contacts with the receiving portion 108, the engaging part 103 pushes the receiving portion 108 in the forward rotation direction. Thus, a force in the forward rotation direction is applied to the outer fit portion 102, whereby the outer fit portion 102 and the scraper 66 rotate in the forward rotation direction. At this time, as illustrated in FIG. 8A, the support mechanism 79 supports the outer fit portion 102 such that the extending portion 110 is positioned close to the inner wall of the storage chamber 63A. Therefore, the scraper 66 is also supported in the first position where the scraper 66 is positioned close to the inner wall of the storage chamber 63A. When the scraper 66 in this state is rotated in the forward rotation direction, the scraper 66 contacts with the sensing surface 68 on the contact surface 66A of the scraper 66 and slides on the sensing surface 68 while being buckled and deformed. Thus, developer accumulated on or toner that forms a deposit on the sensing surface 68 is swept, and agitating is performed.

On the other hand, when the screw feeder 64A is rotated in the reverse rotational direction (the direction opposite to that indicated by the arrow 93), the engaging part 103 moves away from the receiving portion 108 and the shaft-like member 101 rotates inside the sub-tubular portion 112 until the engaging part 104 contacts with the receiving portion 108. For example, when the screw feeder 64A is rotated in the reverse rotational direction from the position illustrated in FIG. 8A, the shaft-like member 101 rotates about the rotation center 105 in the same rotational direction. Therefore, during the rotation, the shaft-like member 101 is gradually lifted up as illustrated in FIG. 8B. Then, when the engaging part 104 contacts with the receiving portion 108, the engaging part 104 pushes the receiving portion 108 in the reverse rotational direction. Thus, a force in the reverse rotational direction is applied to the outer fit portion 102, whereby the outer fit portion 102 and the scraper 66 rotate in the reverse rotational direction. At this time, as illustrated in FIG. 8C, the support mechanism 79 supports the outer fit portion 102 such that the extending portion 110 is farthest from the inner wall of the storage chamber 63A. Therefore, the scraper 66 is also supported in the second position which is distant from the inner wall of the storage chamber 63A and is distant from the sensing surface 68. Even when the scraper 66 in this state is rotated in the reverse rotational direction, the joining surface 66B of the scraper 66 does not contact with the sensing surface 68. Since the scraper 66 does not make contact with the sensing surface 68 even when the scraper 66 is rotated in the reverse rotational direction, the scraper 66 experiences a reduced load. As a result, removal of the attached scraper 66 or disengagement of the screws, or damage such as a breakage of the buckled area of the scraper 66, is prevented.

<Modifications of Embodiments>

Although the developer for use in the developing device 34 is two-component developer composed of toner and carrier in the above embodiments, the present disclosure is not limited thereto. The present disclosure is also applicable to a developing device which uses so-called single-component developer composed of toner only. Furthermore, although the amount of developer is detected with the use of the toner density sensor 67 configured to detect magnetic permeability in the above description, the present disclosure is not limited thereto. For example, an optical sensor that includes a light emitter and a light receiver can be employed. One example of the optical sensor is such that (i) the storage chamber 63A has a detection window through which light is transmitted for the light emitter and the light receiver and (ii) the detection window is cleaned by the scraper 66.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A developing device comprising:

a developer storage container, having a sensing surface therein, configured to store developer;

a remaining amount detecting sensor configured to detect, through the sensing surface, an amount of the developer remaining;

an agitating portion, disposed inside the developer storage container so as to be rotatable, configured to be rotated to thereby agitate the developer;

a contact member, attached to the agitating portion, configured to, when the agitating portion is rotated in a predetermined first rotational direction, move in the predetermined first rotational direction and make contact with the sensing surface; and a support portion, attached to the agitating portion, configured to, when the agitating portion is rotated in the predetermined first rotational direction, support the contact member in a first position where the contact member can make contact with the sensing surface, and, when the agitating portion is rotated in a second rotational direction that is opposite to the predetermined first rotational direction, support the contact member in a second position distant from the sensing surface, wherein the support portion includes:

a shaft-like member connected to a rotation shaft of the agitating portion, the shaft-like member having a center that is distant from a rotation center of the rotation shaft in a direction perpendicular to the rotation shaft;

an outer fit portion, having a hollow inside, configured to fit onto an outer circumferential surface of the shaft-like member; and an extending portion which extends, from the outer fit portion, in the direction perpendicular to the rotation shaft, and to which the contact member is joined, wherein the shaft-like member includes:

a first engaging portion configured to, when the agitating portion is rotated in the predetermined first rotational direction and the shaft-like member reaches a position at which a direction from the rotation center of the rotation shaft to the center of the shaft-like member is the same as a direction in which the extending portion extends, engage with the extending portion and exert a force for moving the contact member and the extending portion in the predetermined first rotational direction; and a second engaging portion configured to, when the agitating portion is rotated in the second rotational direction and the shaft-like member reaches a position at which a direction from the center of the shaft-like member to the rotation center of the rotation shaft is the same as the direction in which the extending portion extends, engage with the extending portion and exert a force for moving the contact member and the extending portion in the second rotational direction.

2. The developing device according to claim 1, wherein the extending portion has a projecting portion which projects toward an inner side of the outer fit portion, the first engaging portion has an engaging surface that is parallel to a straight line connecting between the rotation center of the rotation shaft and the center of the shaft-like member, the engaging surface configured to contact and engage with one side surface of the projecting portion, and the second engaging portion has an engaging surface that is parallel to the straight line connecting between the rotation center of the rotation shaft and the center of the shaft-like member, the engaging surface configured to contact and engage with the other side surface of the projecting portion.

3. The developing device according to claim 1, wherein the contact member is joined to the extending portion at a joining surface of the contact member, and the joining surface is opposite to a contact surface of the contact member on which the contact member makes contact with the sensing surface when the agitating portion is rotated in the predetermined first rotational direction.

4. The developing device according to claim 1, wherein the developer contains magnetic carrier, and the remaining amount detecting sensor obtains a density of the developer by detecting a magnetic permeability of the developer.

5. An image forming apparatus comprising the developing device according to claim 1.

* * * * *